US005992624A

United States Patent [19]

Hodson

[11] Patent Number: 5,992,624

[45] **Date of Patent: *Nov. 30, 1999**

[54] PLUMBER'S CADDY

[76] Inventor: Wesley Hodson, 81 Soundview Rd., Ridgefield, Conn. 06877

[ * ] Notice: This patent issued on a continued prosecution application filed under 37 CFR 1.53(d), and is subject to the twenty year patent term provisions of 35 U.S.C. 154(a)(2).

[21] Appl. No.: 09/040,131

[22] Filed: Mar. 17, 1998

[51] Int. Cl.[6] ..... B65D 85/20; B65D 85/62

[52] U.S. Cl. ..... 206/372; 206/806; 248/318

[58] Field of Search ..... 206/372, 373, 206/576, 806; 248/318, 323, 213.2, 226.11

[56] References Cited

U.S. PATENT DOCUMENTS

| | | | |
|---|---|---|---|
| 4,613,042 | 9/1986 | Aeschliman | 206/372 X |
| 5,564,566 | 10/1996 | Lamb | 206/373 |
| 5,699,910 | 12/1997 | Kubat | 206/373 |

*Primary Examiner*—Jacob K. Ackun
*Attorney, Agent, or Firm*—Michael Schwarz

[57] ABSTRACT

A plumber's caddy is disclosed which provides a holder for plumbing tools, fittings and supplies. An arm permits the caddy to be secured to a member such as a ceiling joist. The arm is jointed in one or more places such that the holder can move relative to the fastener. A swivel joint is disclosed which permits rotation and tilting of the holder relative to the fastener. Hangers are provided for hanging tools from the holder.

38 Claims, 5 Drawing Sheets

PLUMBER'S CADDY

FIELD OF THE INVENTION

The present invention relates generally to the field of plumbing. More specifically, it relates to a plumber's caddy for holding items such as plumbing tools, fittings and materials.

BACKGROUND

Plumbers are routinely required to install and repair piping for water and waste lines. Such piping is typically made of PVC or metal. Work on PVC pipes requires tools, fittings, PVC primer and glue. Work on metal pipes requires tools, fittings and flux.

Water and waste pipes are often located in ceilings and other inaccessible places. There is often very limited space in which the plumber can work in order to gain access to these pipes for installation and repair. The space available for placing tools, fittings and materials is therefore limited. It is therefore very difficult to keep the necessary tools and materials close at hand, especially when the plumber has to work from a ladder and with both hands.

Fittings, primer, glue or flux and tools must be readily accessible to the plumber. Tools can be carried on a belt, but primer and glue usually have to be balanced on the ladder. One solution is to tape the cans of primer and glue. However, spills and drops are still commonplace.

There is a long-felt need to provide some way for plumbers to have easy access to tools, fittings and materials, especially PVC glue and primer, so that their hands are free and so that spills and drops of fittings and tools are minimized. The present invention addresses this long-felt need.

SUMMARY OF THE INVENTION

The invention comprises a plumber's caddy for holding plumbing materials (tools, fittings glue, primer and/or flux). The caddy comprises one or more holders adapted to accommodate such materials. The holder is connected to a fastener, preferably a clamp which secures the caddy to an object such as a ceiling joist. A joint or joint is/are provided between the holder and the fastener to permit the holder to move relative to the fastener. This structure permits a plumber to have ready access to his or her materials when working in a confined space or up a ladder.

A more detailed description of the preferred embodiment of the invention is provided below.

DETAILED DESCRIPTION

Figure 1:
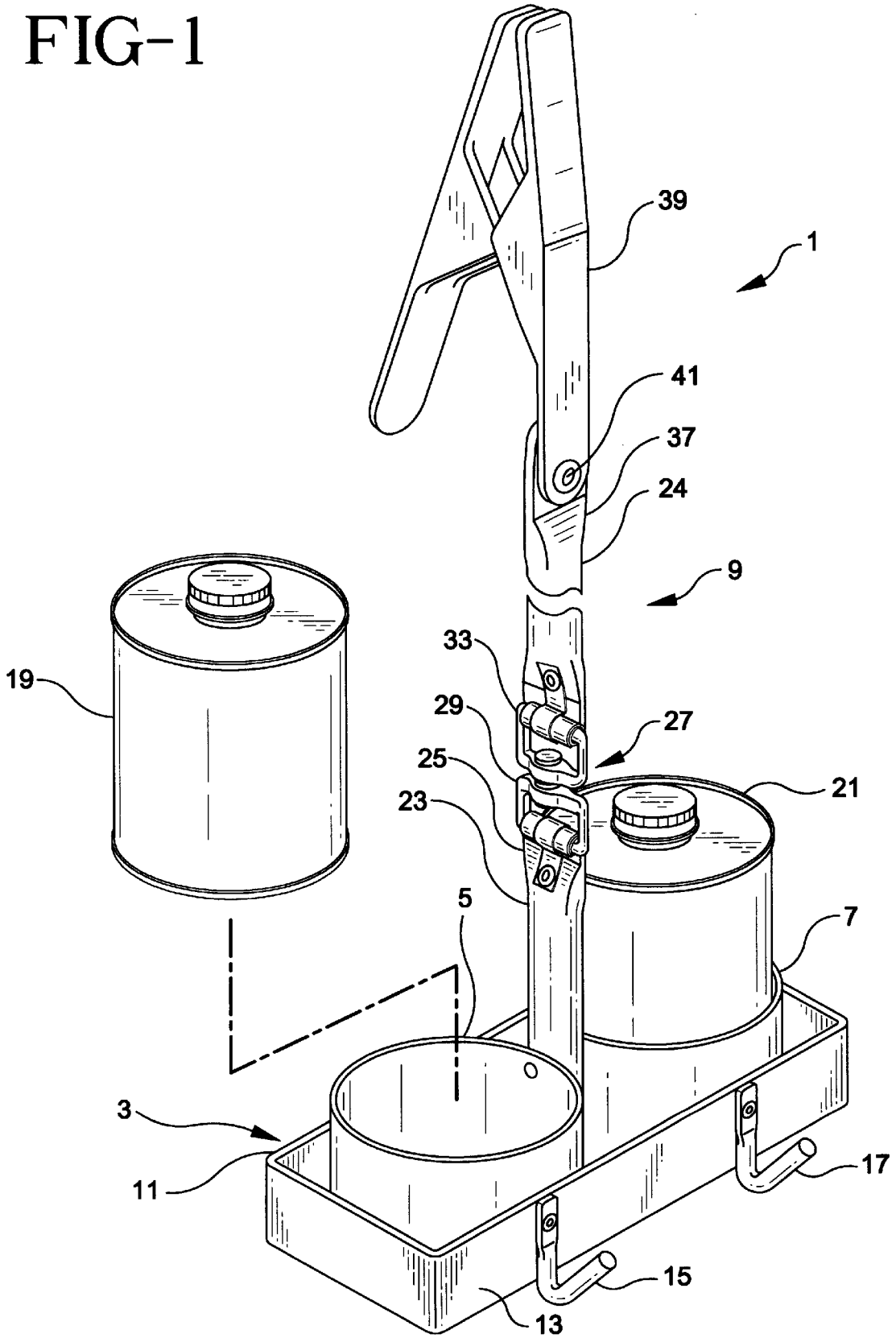
FIG. 1 is a perspective view of the invention.
Figure 2:
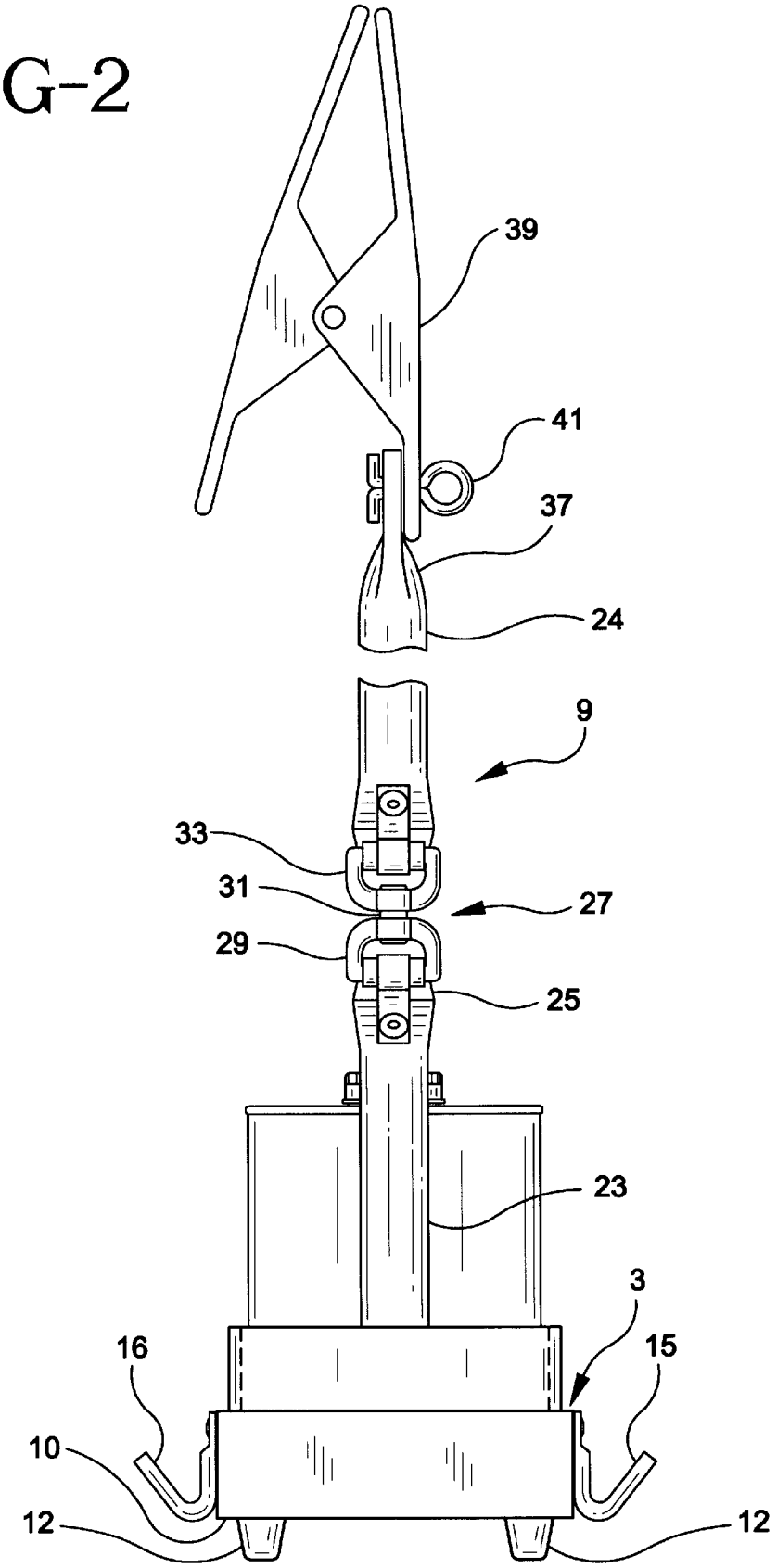
FIG. 2 is a side view of the invention.
Figure 3:
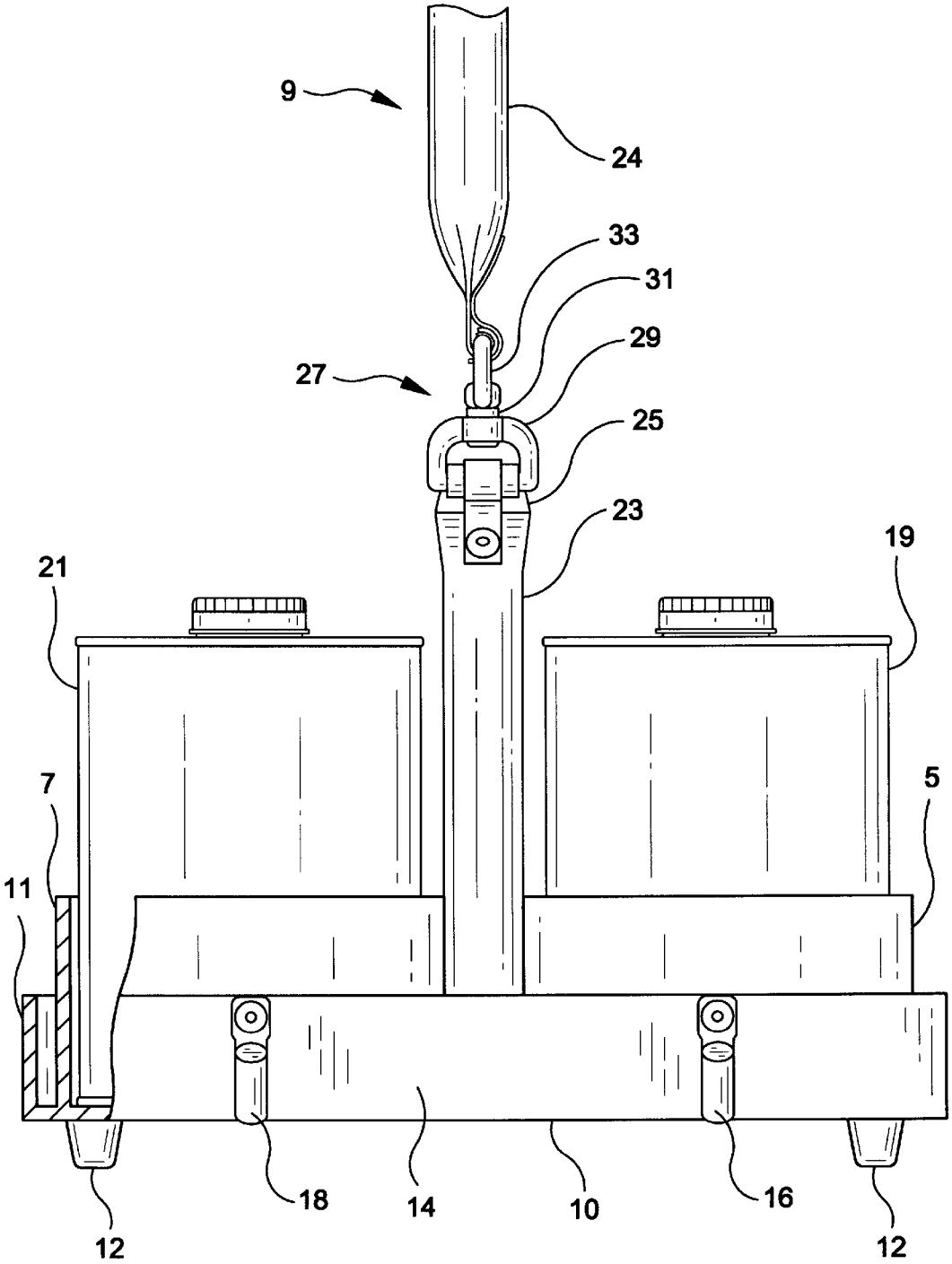
FIG. 3 is a partially cut away rear view of the invention.

The preferred embodiment of the invention is shown in FIGS. 1, 2 and 3. Caddy 1 is designed to hold plumbing materials, including one or more of tools, fittings, glue, primer, flux. Caddy 1 is made up of a shallow base tray 3, two cylindrical holders 5 and 7 and arm 9. Base tray 3 is a rectangular box formed from sheet metal, preferably, 0.5" aluminum angle iron with vertical walls 11, forming a box shape which is useful in holding various small objects. Four plastic feet 12 are secured to bottom surface 10 of base tray

3. Feet 12 allow the caddy to be placed on a flat surface without damaging it (see FIGS. 2 and 3). Cylindrical holders 5 and 7 are dimensioned to receive and accommodate cans 19 and 21 snugly, but such that they can easily be removed. Holders 5 and 7 are cup-shaped members. They are thin-walled circular steel tubes with a circumference of 4.5" and a depth of 2". Cans 19 and 21 are commercially available PVC primer and glue cans, well known to plumbers. Attached to front wall 13 by means of rivets are two galvanized steel hangers, 15 and 17. Hangers 15 and 17 are for hanging tools such fitting brushes and saws. Similar hangers 16 and 18 are provided on rear wall 14 (see FIG. 3). The structure just described allows the caddy to hold a variety of plumbing supplies and tools.

Arm 9 is an aluminum pipe with an outer diameter of approximately 0.5". Arm 9 comprises post 23 and upper member 24. Upper member is shown broken into two parts in FIG. 1. It is however a unitary member of about 18" in length.

Post 23 is secured to tray 3 by welding and is thus connected to holders 5 and 7. It could of course be connected directly to holders 5 and 7. The upper (hinged) end 25 of post 23 is flattened, folded and riveted to form a hinge to secure swivel joint 27. Swivel joint 27 is a commercially available joint made up of three parts—lower joint member 29, axle 31 and upper joint member 33. The first, lower joint member, 29 is stirrup shaped. The lower part of lower joint member 29 is journaled in the hinged end 25 of post 23 so that it can tilt. Rotation is provided by axle 31 which connects lower joint member 29 to second, upper joint member 33. Upper joint member 33 is journaled to upper member 24 in the same way as first member is journaled to post 23. That is to say, lower end 35 of upper member 24 is flattened, folded over and riveted to form a hinge which allows tilting.

Arm 9 has an upper end 37. This end is flattened and has a hole punched or drilled through it. Fastener 39 is secured to upper end 37 by means of cotter pin 41. This provides a joint which permits fastener 39 to rotate about cotter pin 41 and thus move with respect to tray 3 and hence holders 5 and 7. Cotter pin 41 thus allows caddy 1 to be secured to a vertical or horizontal joist while remaining parallel to the floor. This overall structure of arm 9 provides a universal joint which allows movement of tray 3 and hence holders 5 and 7 relative to fastener 39.

Fastener 39 is preferably a commercially available carpenter's clamp. It is spring loaded with a spring having sufficient stiffness that when the clamp is attached to an object such as a ceiling joist, it can secure caddy 1, fully loaded without slippage.

It will be recognized by persons of ordinary skill in the art that a wide variety of variations on the basic structure just described can be used to implement the invention. For example, holders 5 and/or 7 and/or tray 3 could be replaced with baskets made of metal or plastic. The entire structure could be made of a unitary plastic molding. Post 23 and/or upper member 24 could be made of a variety of metals or plastics. They could also be light I-beams or other such members. Fastener 39 could be a C-clamp, or a quick release clamp. Movement of the holders relative to fastener 39 and/or arm 9 could also be accomplished by a variety of joints, the joints being placed at various points between holders 5 and 7 and fastener 39, the purpose of the joints simply being to provide movement in several dimensions to allow the caddy to be secured to members of different orientations.

Figure 4:
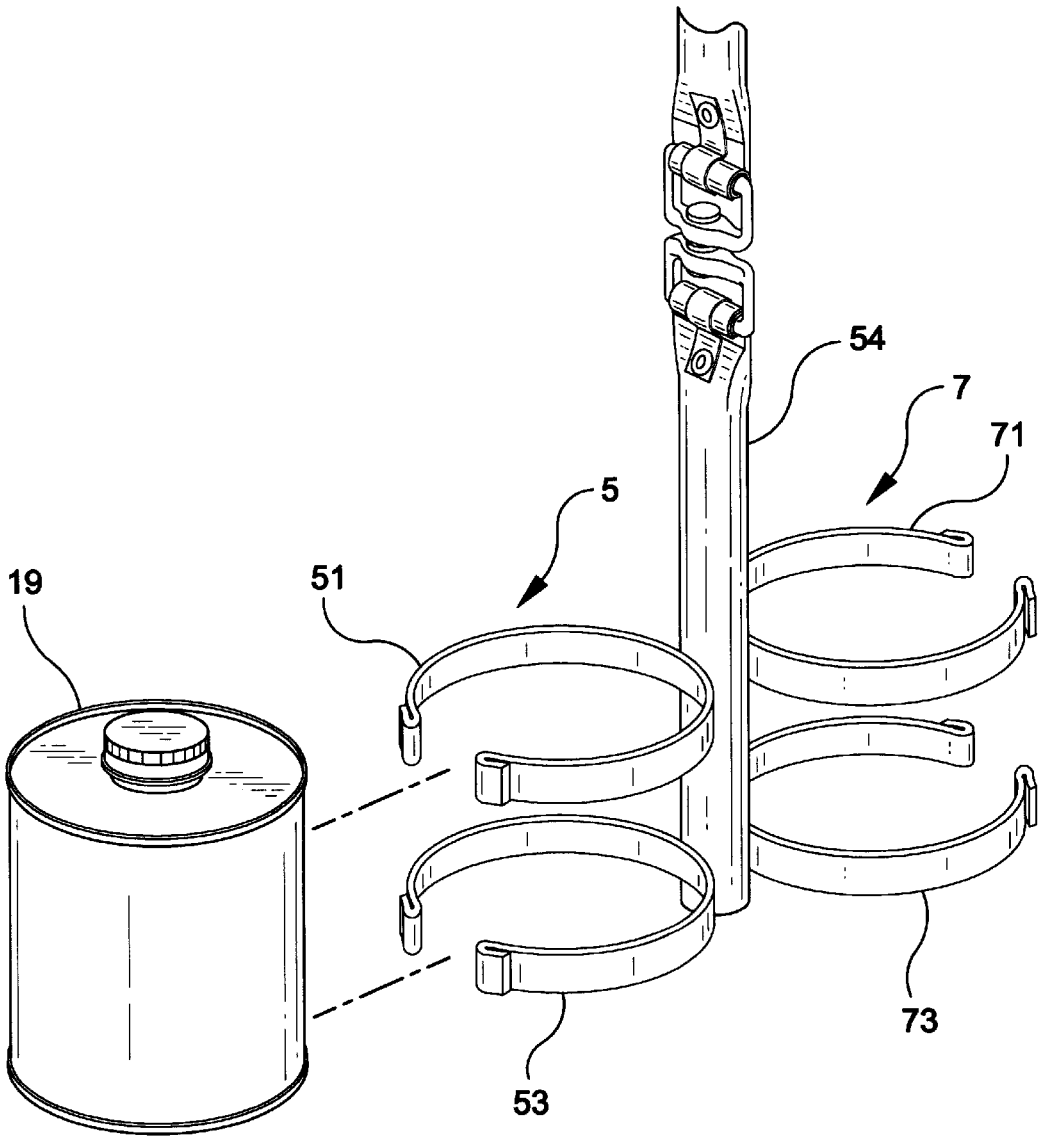
FIG. 4 is a perspective view of a first alternative embodiment of the invention.

One alternative embodiment is shown in FIG. 4. In that embodiment, holder 5 is in the form of clips 51 and 53 and holder 7 is in the form of clips 71 and 73. Clips 51, 53, 71 and 73 are identical. They are made of a resilient material such as steel or plastic and welded, riveted or glued to vertical member 54. Clips 51, 53, 71 and 73 are dimensioned and spaced along vertical member 54 such that cans 19 and 21 can clip into them and fit snugly and such that cans 19 and 21 can easily be released for replacement or refilling.

Figure 5:
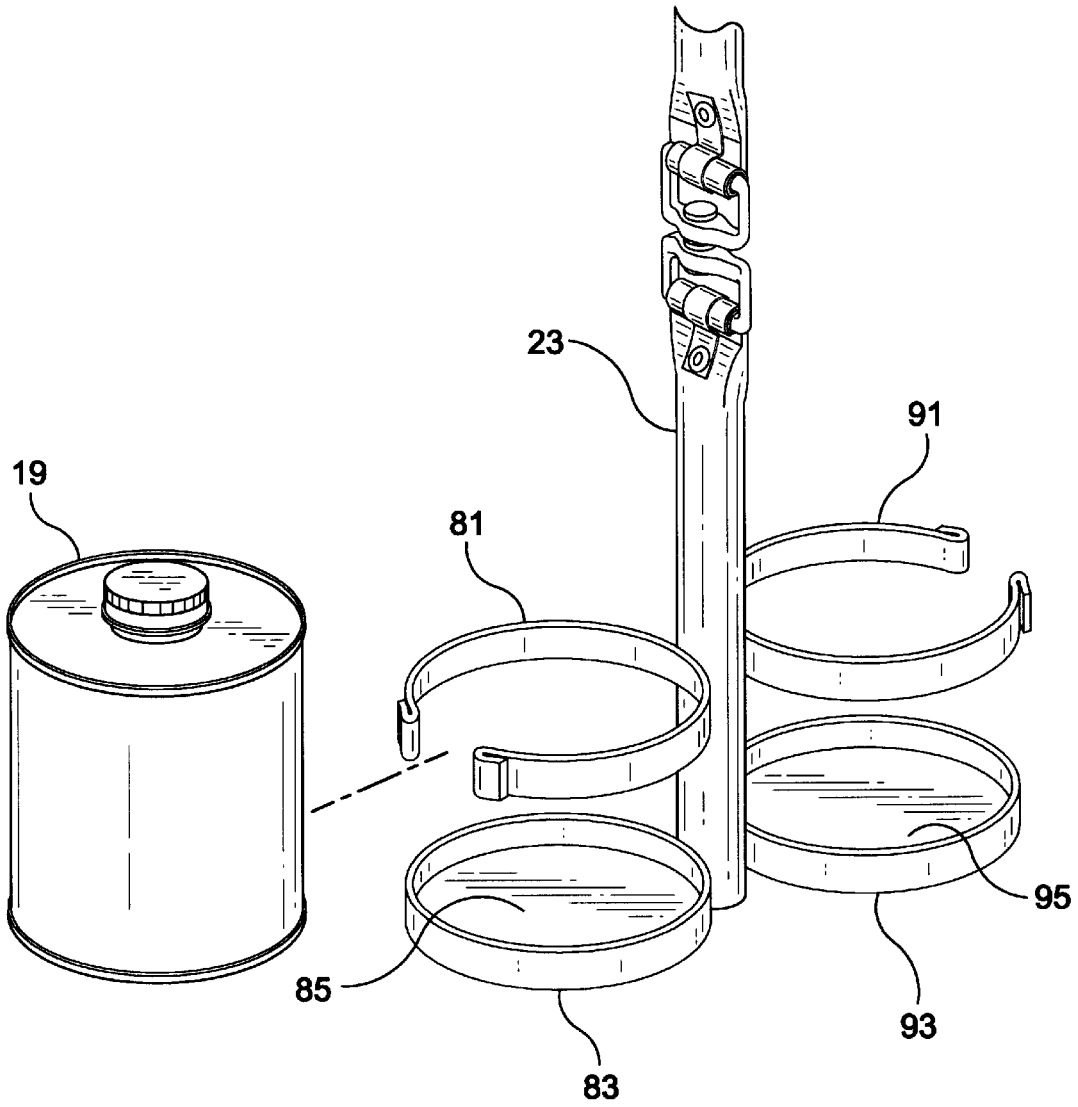
FIG. 5 is a perspective view of a second alternative embodiment of the invention.

A second alternative embodiment is shown in FIG. 5. In this embodiment, pans 83 and 93 are secured to post 23. Pans 83 and 93 have flat bases 85 and 95 respectively and are dimensioned so that the bases of cans 19 and 21 can rest in them. Cans 19 and 21 are secured by clips 81 and 91 which are similar to clips 71 and 73.

While the invention has been described with reference to its preferred embodiment, it will be appreciated by those of ordinary skill in the art that various modifications can be made to the preferred embodiment without departing from the spirit of the invention or limiting its scope.

I claim:

1. A plumber's caddy comprising:

a first holder shaped to receive plumbing materials;

a clamp for releasably securing the caddy to a joist-like member such that the caddy hangs vertically from the joist-like member;

an arm secured to the first holder and extending generally upwardly away from the first holder toward the clamp;

a joint connecting the arm and the clamp, such that the first holder can rotate about the joint with respect to the clamp.

2. The caddy of claim 1 further comprising a second holder connected to the first holder.

3. The caddy of claim 1 wherein the first holder is adapted to receive a container.

4. The caddy of claim 1 wherein the first holder comprises a cup-shaped member.

5. The caddy of claim 1 wherein the first holder comprises a clip.

6. The caddy of claim 1 wherein the first holder is adapted to receive a glue or primer container.

7. The caddy of claim 2 wherein the second holder is adapted to receive a container.

8. The caddy of claim 2 wherein the second holder is adapted to receive a glue or primer container.

9. The caddy of claim 2 wherein the second holder comprises a tray.

10. The caddy of claim 1 wherein the joint permits the arm to tilt with respect to the clamp.

11. The caddy of claim 1 wherein the arm comprises a second arm interposed between the clamp and the joint, connecting the clamp to the joint.

12. The caddy of claim 11 further comprising a second joint connecting the clamp to the second arm, such that the second arm can rotate about the second joint relative to the clamp.

13. The caddy of claim 1 further comprising a hanger connected to the first holder.

14. A plumber's caddy comprising:

a first holder shaped to receive plumbing materials;

a second holder shaped to receive plumbing material;

a first member connected to the first holder and the second holder and extending generally upwardly away from the first holder and the second holder;

a second member;

a first joint connecting the first member and the second member such that the first member can rotate about the joint with respect to the second member;

a clamp connected to the second member, the clamp being adapted to releasably secure the caddy to a joist-like member such that the caddy can hang vertically from the joist-like member.

15. The caddy of claim 14 further comprising a tray connected to the first member.

16. The caddy of claim 14 wherein the first holder is adapted to receive a container.

17. The caddy of claim 14 wherein the first holder comprises a cup-shaped member.

18. The caddy of claim 14 wherein the first holder comprises a clip.

19. The caddy of claim 14 wherein the first holder is adapted to receive a glue or primer container.

20. The caddy of claim 14 wherein the first and second holders are adapted to receive a container.

21. The caddy of claim 14 wherein the first holder is adapted to receive a glue container and the second holder is adapted to receive a primer container.

22. The caddy of claim 14 wherein the first joint permits the first holder to tilt with respect to the clamp.

23. The caddy of claim 14 further comprising a second joint connecting the clamp to the second member, such that the second member can turn relative to the clamp.

24. The caddy of claim 14 further comprising a hanger connected to the second holder.

25. A plumber's caddy comprising:

a first holder shaped to receive plumbing materials;

a clamp for releasably securing the caddy to a joist-like member such the caddy can hang vertically from the joist-like member;

an arm having a holder part and a clamp part, the holder past being connected to the first holder and the clamp part being connected to the clamp, the arm extending generally upwardly away from the first holder towards the clamp, the comprising a joint connecting the holder part to the clamp part such that the holder part an rotate about the joint relative to the clamp part.

26. The caddy of claim 25 further comprising a second holder connected to the holder part.

27. The caddy of claim 25 further comprising a joint in the arm such that the joint permits the first holder to move relative to the arm.

28. The caddy of claim 25 further comprising a tray connected to the holder part.

29. The caddy of claim 25 wherein the first holder is adapted to receive a container.

30. The caddy of claim 25 wherein the first holder comprises a cup-shaped member.

31. The caddy of claim 25 wherein the first holder comprises a clip.

32. The caddy of claim 25 wherein the first holder is adapted to receive a plumbing glue or primer container.

33. The caddy of claim 25 wherein the second holder is adapted to receive a container.

34. The caddy of claim 25 wherein the second holder is adapted to receive a plumbing glue or primer container.

35. The caddy of claim 25 wherein the arm is adapted to permit the first holder to rotate with respect to the fastener.

36. The caddy of claim 25 wherein the arm is adapted to permit the first holder to tilt with respect to the fastener.

37. The caddy of claim 25 further comprising a second joint connecting the clamp to the arm, such that the clamp part can rotate relative to the clamp.

38. The caddy of claim 25 further comprising a hanger connected to the first holder.

* * * * *